United States Patent [19]

Hechler, IV

[11] 4,277,030

[45] Jul. 7, 1981

[54] SPRAY AND FOAM DISPENSING NOZZLE

[76] Inventor: Valentine Hechler, IV, 26 Meadow View Rd., Northfield, Ill. 60093

[21] Appl. No.: 938,897

[22] Filed: Sep. 1, 1978

Related U.S. Application Data

[63] Continuation-in-part of Ser. No. 651,521, Jan. 22, 1976, abandoned, which is a continuation-in-part of Ser. No. 615,800, Oct. 22, 1975, abandoned, which is a continuation-in-part of Ser. No. 520,676, Nov. 4, 1974, Pat. No. 3,984,053.

[51] Int. Cl.[3] ..... B05B 7/04

[52] U.S. Cl. ..... 239/407; 137/889; 137/891; 137/896; 239/427.5; 239/428.5; 239/432; 239/443; 239/553; 285/260; 285/DIG. 22

[58] Field of Search ..... 137/604; 239/310, 316, 239/317, 318, 335, 336, 340, 343, 344, 350, 353, 390, 396, 397, 407, 413, 414, 416, 416.4, 417, 427.3, 427.5, 428.5, 432, 518, 524, 461, 505, 507, 508, 512, 552–553.5, 590–590.5, 311, 443; 251/319; 285/260, 332, DIG. 22, 423

[56] References Cited

U.S. PATENT DOCUMENTS

| | | | |
|---|---|---|---|
| 2,527,848 | 10/1950 | Prack | 239/443 X |
| 2,761,516 | 9/1956 | Vassilkousky | 239/428.5 X |
| 2,908,227 | 10/1959 | McDougall | 239/310 X |
| 2,965,309 | 12/1960 | Parrott | 239/310 |
| 3,057,561 | 10/1962 | Corlett, Jr. | 239/524 |
| 3,094,171 | 6/1963 | Gagliardo | 239/343 X |
| 3,194,254 | 7/1965 | Zmek | 137/604 X |
| 3,308,998 | 3/1967 | Oppasser et al. | 285/DIG. 22 X |
| 3,338,173 | 8/1967 | Gunzel, Jr. et al. | 137/604 X |
| 3,401,774 | 9/1968 | Krahn | 285/332 X |
| 3,640,552 | 2/1972 | Demler, Sr. et al. | 285/DIG. 22 X |
| 3,892,361 | 7/1975 | Mocarski | 239/432 |

FOREIGN PATENT DOCUMENTS

| | | | |
|---|---|---|---|
| 8223 | of 1910 | United Kingdom | 239/396 |

*Primary Examiner*—Andres Kashnikow

*Attorney, Agent, or Firm*—Sixbey, Friedman & Leedom

[57] ABSTRACT

A versatile portable fluid dispensing, manually controlled gun with instant selectivity of hard, soft or foam flow of liquids, either of water or a solution, with or without entrainment of fluid such as air and with or without a foaming flow of the fluid whereby each of a great many different relations of discharge can be selected with a versatile solution discharge nozzle that provides selectively changeable liquid solid jet streams or soft flows of liquids with or without entrainment of a fluid such as air; and selectively with entrainment of air operable either with or without a foaming agent in the liquid. Instant controls interchangeably operated provide any one of twelve different dispensing relations with water alone or with a chemical foaming agent, each supplied separately or together as a mixture; in each of these phases, namely jet flow, soft flow and foam flow.

23 Claims, 5 Drawing Figures

SPRAY AND FOAM DISPENSING NOZZLE

CROSS-REFERENCES

This application is a Continuation-In-Part application of Ser. No. 651,521 dated Jan. 22, 1976 (now abandoned) which in turn is a Continuation-In-Part application of Ser. No. 615,800, dated Oct. 22, 1975 (now abandoned), which in turn is a Continuation-In-Part application of Ser. No. 520,676, dated Nov. 4, 1974 now U.S. Pat. No. 3,984,053.

Hechler Pat. Nos.:
No. 3,862,640, Jan. 28, 1975
No. 3,863,665, Feb. 4, 1975
No. 3,863,843, Feb. 4, 1975

BACKGROUND OF THE INVENTION

As a general rule, one-purpose nozzles and single purpose streams are provided for dispensing a particular liquid or solution which is ejected under pressurized flow conditions for different one purpose types of discharge flows. Assuming a liquid entering a discharge nozzle under pressure, its ejection force can be controlled by different nozzles for particular applications such as a hard stream, either as a spray or pencil stream, a soft flow or foam flow. And, in the soft-flow category the ability to control or vary the distance of the projection of a discharge stream is quite difficult, particularly where the supply pressure of the water varies as experienced with various municipal water systems.

SUMMARY OF THE INVENTION

One of the objects of the invention is to convert selectively nozzle discharge from a fixed orifice into a hard jet flow, a soft flow and a foam flow having varying characteristics with respect to soft and foam flows.

Another object, under finger-tip control, is to apply progressively under pressure, quickly and successively, a foam on a wall or object at an appreciable distance for cleaning, and rinsing away the foam and dirt with the same source of water, with hard or soft jets of water, with or without wall treatment fluids.

Not only does the present invention maintain a high degree of proportioned mixture accuracy under varying water pressures as described in the above cross-references, but it enables the use of mixtures to provide a soft flow or foam even though confronted with pressure differences at the discharge nozzle which are related to its size or any air entrained. The foam result and the application of the foam or a soft flow of a mixture without foam can also be varied with respect to relative distances between the nozzle and a surface that is to be contacted.

In the present invention an essentially soft flow nozzle provides very little flight distance in order to avoid splash as when filling a bucket, yet can be adjusted to provide a flight of substantial distance up to 10 feet for both soft stream and foaming stream flow, and, up to a hundred feet or more a jet stream of water depending upon local water pressures. The relative ejection port area and any amount of air selectively admitted to the nozzle chamber can be varied instantly to provide a hard stream or jet stream on a moments notice as well as the mixture of the mixer and its ratio with respect to the amount of effect of a foaming agent and wash down required.

Preferably, a chamber is provided beyond a fixed final flow restriction nozzle and is much larger in cross-section than that of the nozzle. Moreover, it preferably has a gradually expanding wall which assures a pressure drop at an air entrainment opening or openings to the chamber near the nozzle which can be effective adjustably to aspirate and entrain air in the mixture that is moving in the chamber, the area of these openings and those of the nozzle and outlet provide related flow area ratios. The flow area of the air aspirating opening or openings can be selectively and adjustably used for soft flow, or foaming jet stream from the nozzle that can be selectively discharged intact from the chamber, or be broken up to provide a soft flow from the chamber, with or without air entrainment.

IN THE DRAWINGS

Figures 1, 2, 3, 4, 5:
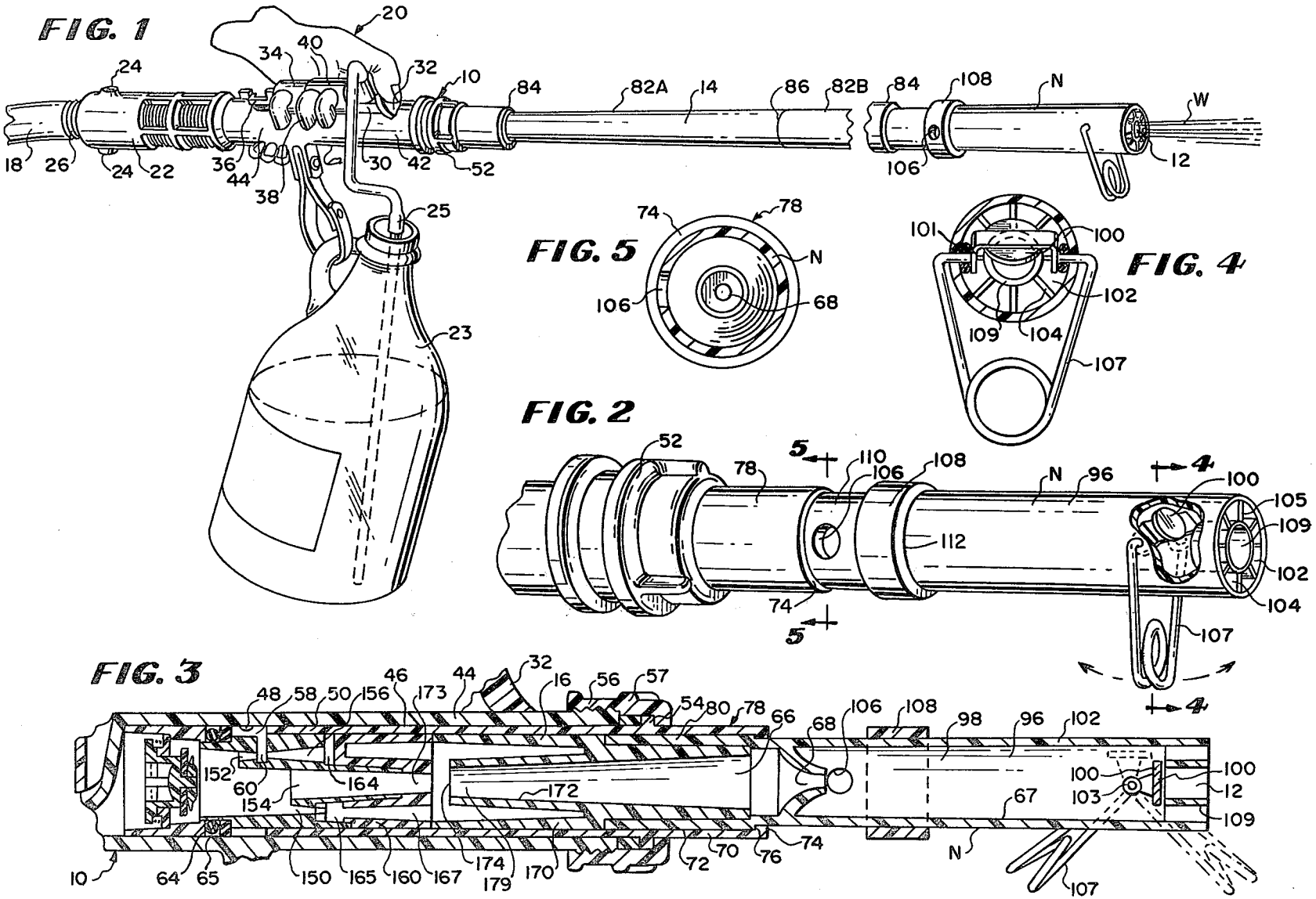
FIG. 1 is a perspective view of the proportioning mixer-dispenser assembly with an extender and a selecter flow nozzle embodying the invention.
FIG. 2 is an enlarged perspective view of a flow nozzle embodying the invention selectively adjustable for soft flow from the nozzle with or without aeration, and for dispensing foam with aeration through soft flow directing vanes with a turbulence target in the jet stream; or, a hard jet flow from the nozzle without aeration when the target is removed from the path of the jet.
FIG. 3 is a longitudinal sectional view showing the internal combination of the nozzles and working elements embodying the invention illustrating the alternate selective positions of the turbulence control target and illustrating the alternate selective positions of the turbulence control target.
FIG. 4 is a section taken on line 4—4 in FIG. 2.
FIG. 5 is a section taken on line 5—5 in FIG. 2.

For further detail and description of the associated parts and their assembly, incorporation by reference is hereby made of the parent application, Ser. No. 615,800.

DESCRIPTION OF THE EMBODIMENTS

The invention will be described, by way of example, as related to the proportioning, mixing and dispensing of municipal water supplied under pressures of 15 to 100 p.s.i.g. serving as a solvent, and a chemical concentrate or foaming agent or solution of both, serving as a solute having a free open flow to the proportioning-mixer and is subject only to minor gravity influences, either positive or negative, if at all.

The mixture is dispensed from a gun 10 under pressure preferably through an adjustable multi-purpose nozzle N constructed, to discharge a hard stream of, (a) a solvent such as water W, or (b) a solution, through a central port 12 to provide selectively;

1(*a*) or 1(*b*) a pressure jet stream discharge from the gun, or

2(*a*) or 2(*b*) a soft flow through flow-directional vanes around the target, by obstructing the jet flow through the central port 12 with a quickly adjustable target 100, and in the latter event,

3(*a*) or 3(*b*) with or without aeration controlled by the openness of an air port 106 in the wall of the nozzle housing adjacent to the jet port 12. All of the above purposes may be served with or without an extender conduit 14 defining a gradually enlarging pressurizing passage between the nozzle N and the proportioning-mixer 16 (FIG. 3).

The invention is illustrated as part of a manually controlled automatically vented proportioner-mixer-dispenser gun 10, such as illustrated in the Hechler Application Ser. No. 615,800 or the Hechler U.S. Pat. No. 3,862,640. The gun 10 is preferably connected to the outlet of a garden hose 18 to utilize municipal water pressure having a working pressure that may be considered to be 40 p.s.i.g., for purposes of description, and the liquid dispensed from the other end of the gun 10 may be water alone or a mixture as controlled by a person 20 holding and manipulating the gun and the controls to which a solute supply 23 is connected, by eduction conduit 25.

SOLVENT SUPPLY AND FLOW CONTROL

The inlet end 22 of the gun 10 receives an adapter selected for the source of solvent and it is held in place by screws 24. As shown, the adapter has a threaded opening mating only with an outlet male fitting 26 such as those conventionally provided on a garden hose 18 for dispensing municipal water.

In controlling the solvent flow, a manual valve more particularly described in said application Ser. No. 615,800 includes a valve (not shown) controlled by a push rod 30 having a thumb handle 32 actuated manually which also selectively actuates a normally closed solute flow valve 34. At its rear end a manual release spring latch hook element 36 is provided selectively to hold the push rod 30 open continuously if desired for dispensing.

SOLUTE SUPPLY

The solute supply 23 is designed for free flow for aspiration by the solvent when used and although the supply tube 25 could lead directly to the mixing zone inlet opening 38 it is preferred to valve, ON or OFF, any liquids serving as the solute, or portion thereof, or simultaneously with the water to avoid handling spillage through a mechanical connection (not shown) with the manual actuator 32 when solute is used. The normally closed solute valve 40 is located on top of the outlet end 42 of the housing 44 as a unit at the rear of the thumb handle 32. During a mixing operation with the solute and solvent valves open the free flowing solute is under approximately zero gauge pressure within +2 p.s.i.g. Either plain solvent or a chemical solution can be discharged merely by selectively turning the solute valve shaft 34 a quarter turn for an interference latching relationship with the push rod 30 to open the solute valve for solute flow as the solvent valve is opened. The selection provides for either the solution flow or the flow of solvent alone.

PROPORTIONING AND MIXING

The housing 44 provides a proportioning mixing chamber inner wall 46 adjacent to its outlet end 42 which receives solvent from the main valve (not shown) and solute through the opening 48 (FIG. 3) in the side wall thereof. The chamber 46 is molded and tapers inwardly slightly. The mixer-proportioner unit 16 received in the mixing chamber comprises an outer shell 50 (FIG. 3) whose outside surface correspondingly tapers inwardly slightly from an external flange 54, the same as the inner wall 46 of the housing 44 for ready placement and replacement therein as held in place by a gland nut 52 threaded at 56 to the outer end of the gun housing 44. Adjacent the inner end of the shell an external circumferential solute feed groove 58 is provided for coincidence with the opening 48 in the housing wall 50 and has an opening 60 from the groove to the interior of the shell 50 for flow of solute to the primary stage of the proportioner-mixer assembly 16. Closer to its inner end the shell 50 has an external shouldered space 58 receiving an O-ring 64 sealing against the escape of any liquid at this point. The solute and solvent are proportioned and mixed under continuous flow in the multi-stage mixer 16 and discharged to any one of the plural discharge nozzles more particularly described in said application Ser. No. 615,800, incorporation of which is hereby made by reference for comparison also. Therein the hard flow and the soft flow are embodied in a single nozzle N capable of either function and others also.

The inside wall of the shell tapers inwardly to receive the plural stage proportioner-mixer assembly of elements press-fitted therein permanently in correct orientation. The invention is illustrated with three elements collectively providing three interrelated stages permuted from a wide selection of defined different mixing zone inlet and outlet port sizes and for different but determined output ratios. The upstream element core thereof forms the converging wall nozzles 150, 152 and 154 of all three stages and the downstream core forms the diverging wall energy converter 156 of the first stage. A saw cut kerf forms the confluence gap or mixing zone 60 therebetween in communication with the opening 48 to introduce the solute. The third stage nozzle 154 is axially located; the first stage nozzle 150 and diverging wall energy converter 156 are located laterally thereof on one side and the second stage nozzle 152 is divided into several nozzles located on the other side of and spaced around the third stage nozzle 154.

The intermediate element 160 centrally telescopes over the third stage nozzle 154. It provides the axial space second stage mixing zone 164 with diverging wall energy converters 167 disposed in alignment with the second stage nozzles 152 and provides an axial space 164 between the elements which serves collectively as an outlet chamber 165 for the first stage confluence mixing zones 164 of axial space for the second stage nozzles.

The final stage element 170 provides the diverging wall energy converter and mixing zone 172 of the third stage nozzle having the solvent inlet port 173 and an outlet port 66. It is disposed in axial alignment with its nozzle 154 and is spaced therefrom to provide an orifice as a space 174 that receives the output from the second stage mixer 164 and supplies it as a solute to the confluence zone 179 of the third stage mixer 172.

In manufacture, the triple mixer-proportioner lends itself for quick molding changes from one set of ratios to another merely by changing pin sizes in the cores, or, by not using pins to form the nozzle of any one of the mixer stages if only a two-stage pump is designed.

For example, with two-stage free flowing solute system, the relative diameters of the port flow areas may be as follows for an overall ratio of 1:24 and rate of flow at 6 gallons per minute of water as a solvent:

| | Zone Inlet Port | Zone Outlet Port |
|---|---|---|
| First stage | .0664" | .1713" (1-3) |
| Second stage | .0885" | .2056" (1-8) |

Also by way of example, but not limitation, the relative diameters of the port flow areas for a free flowing solute system are as follows for an overall ratio of 1:64 and rate of flow at 6 gallons per minute of solvent at 40 p.s.i.g.:

| | Zone Inlet Port | Zone Outlet Port |
|---|---|---|
| First stage | (155) .0395 D | (157) .0527 D (1:4) |
| Each of 3 second stages | (163) .1582 D | (165) .0776 D (1:4) |
| Third stage | (173) .1996 D | (175) .2677 D (1:4) |

Rate of flow is related to solvent pressures. The relative sizes of the inlet and outlet ports of the stages determine the ratio, their overall sizes the rate of flow. Preferably, the first stage is less than 1 to 5 and if the ultimate ratio is above a 1 to 4 ratio (20% solution) the overall system ratio is divided up between the other stages in such a way that the first stage ratio resides in that area where there is minimum degradation, a minimum degradation for the overall system is attained. This essentially relates the elements of the invention and ultra high ratios may be provided.

For example, if a 1 to 16 system ratio is desired and a single stage 1 to 16 proportioner is used, degradation is based upon 1 to 16. If a two-stage system is used and is divided arbitrarily on a 1 to 4, 1 to 4 basis, which still provides 1 to 16 overall, the degradation of the first stage would then be based on the 1 to 4 ratio rather than the 1 to 16. This essentially cuts down the degradation of the overall system. The first stage isolates the following stages with respect to degradation.

The importance of this system is noted when compared with a single stage 1 to 16 system that might have a degradation of plus or minus 20% for a given lift height change. By using the two-stage system this is cut down to only plus or minus 5% for the same lift height change. The two stages have reduced that which may be intolerable at 20% to a 7% variation that is much more tolerable.

In implementing this concept, it may be noted that pressure upon incoming solvent is converted to kinetic energy as it flows into the mixing chamber and whatever pressure there is on the solute becomes the pressure in the mixing chamber. If the kinetic energy is never reconverted to pressure, the ultimate pressure upon the mixture even if it passes through several mixing chambers the unit will not act as a predictable proportioner.

If there is to be any pressure on the resulting mixture, the kinetic energy must be reconverted to pressure in whole or part. This is done by conducting the mixture from the mixing chamber outlet through a progressively enlarging passage and the pressure thus established becomes the solute pressure in the next mixing chamber.

If the final output pressure is to be soft flow, as in a dispenser, the mixer passageways need only bring the succeeding mixing chambers to atmospheric pressure for final discharge. If the first output pressure is to provide a hard flow from a nozzle, diverging walls of the mixer passages are designed in a well-known manner to optimize the pressure upon the mixture for use as the solute in the next stage to establish higher pressures in succeeding mixing zones as in an applicator.

The jetting water molecules freely and fully transfer flow energy in proportion to their jet strength to entrain molecules of the solutes in the mixing zones and the diverging walls convert energy in relation to the relative sizes of the inlet and outlet ports thereof to mix the confluent liquids. Preferably, there is substantial pressure on the resulting mixture, the kinetic energy is reconverted to pressure in whole or part. This is done by conducting the mixture successively from mixing chamber outlets through progressively enlarging passages and the pressure thus established becomes the solution pressure for discharge to either one of the nozzles directly or through the extension conduit 14.

MIXER ACTION

Where the solute can or does flow freely to a mixer chamber regardless of the solvent pressure thereon, there is very little degradation of the mixture output ratio with all stages related to a theoretical mathematical formula.

In the present invention, contrary to the practice in conventional single-stage mixer-proportioners, the discharge opening 68 may be equal in the flow area to the last stage outlet port 179 as when no diverging section is utilized in the last mixer stage, and, within substantial tolerances, when a diverging mixing zone follows the last stage of the mixer, the last stage outlet port can be safely less in flow area to improve jet discharge up to but not beyond the point where the equalization of solvent and solute mixture pressure is distributed in the mixing zone of that stage. Accordingly, with pressure built up on the latter instance, the extension conduit 14 (FIG. 1) of a reasonable knock-down shipping length is mountable on the gun and can be used interchangeably between the mixer-proportioner and discharge nozzles without disturbing the mixture ratio.

DISCHARGE NOZZLES AND EXTENDER JOINTS

The outlet end of the shell 70 of the mixer-proportioner unit 16 extends beyond the flange 54 and internally defines a diverging conical tapering surface 72 ending in an internal flange 74 of a few thousandths of an inch reduced diameter (FIG. 3) and may be considered to be a locking flange when fully engaged. The extension, tapering surface and flange 74 may be termed a female joint member 78.

Received within this joint member 78 may be any one of a selection of dispensing nozzles, including the single multi-purpose nozzle N, or the extender conduit 14, which terminally has a corresponding but external taper terminating at the upstream end in mating relation with the surface 72 and having an external groove or shoulder 76 of a few thousandths of an inch deep. The taper surface 72 and flange 76 may be termed a male joint member 80 and may be repeated intermediate the conduit sections 82A and 82B (FIG. 1) with corresponding taper and flange elements at a joint 86. The extender conduit is provided with a female joint member 84 at its joint and outlet end and the dispensing nozzle N is provided with the male joint member 80 at its inlet ends for interchangeable use on the extender conduit or the mixer-proportioner.

The joint members 78, 80, 82 and 84 have a wall thickness of approximately 1/16" (1.59 mm) thick and frictionally overlap about one inch with a taper of 0.25" (6.35 mm) in 12" (30.48 cm.). Their walls are glass smooth as molded from an acetal resin such as marketed under the trademark "Delrin" by E. I. duPont de Nemours & Co.

The overlap provided by these tapers cannot be easily tightened or released by relative axial or rotary movement, but with this wall thickness the tapers of two mating ends when telescoped can be easily flexed laterally back and forth from coaxial alignment in a common plane whereby the joint ovates transversely of the plane enough to tighten the contact on one side while the contacting surfaces on the other side loosen and slide in their engagement in a longitudinal direction under the repeated reversals of flexing. The joint tightens or loosens depending on the direction of opposing axial forces that are additionally applied to the joint during flexing. This planar flexing at the joints enables all parts to be properly oriented in proper alignment without any critical adjustment conventionally required with threaded or bayonet type joints, there being no rotational adjustment possible or required after final assembly even with a tubular elbow section that may be used as one of the conduit elements. Rotational orientation can be provided before the joints are tightened.

The distance that the mixture travels after it passes from the last stage mixer orifice 174 to the final fixed-flow restrictive orifice 68 is a consideration in determining the ratio of relative sizes of the two orifices. If the distance is zero, the final orifice would be the same as the last stage orifice 174; in fact, either orifice could serve separately in place of both orifices. However, if the distance is substantial, as where an extension conduit is used, there is some loss of energy between the orifices which could be as much as 6% as related to the fourth power of the relative diameters. With the flow divergence of the extension conduit, the loss would only be a loss approaching 3% of the energy.

In the present invention, it has been found that with the long divergence present with the extension conduit 14 to transmit the flow over the distance indicated herein, in which the passage is preferably round, the velocity is cut down as a matter of content at the beginning of the transmission to a few percent total energy content so that maximum energy can be transmitted over relatively long distances as pressure with minimal loss of energy. Any losses therefrom can be minimal and, at the end of the wand the energy is reconverted to a pressure head and through a final nozzle 68 converted back into velocity energy again.

DISCHARGE NOZZLE

The discharge nozzle N associated with the flow areas of the mixer proportioner described, operates selectively on either one of two types, soft flow and hard flow. As already partly described, the cylindrical housing 96 (FIG. 3) is provided with the male joint member 80 having the converging throat dispensing opening 68 with a flow area related to the third stage outlet port flow area 66 of the mixer which directs a discharge stream axially through a zone 98 against a movable target 100 (FIG. 3) releasably supported on a pattern of vanes 105 at the outlet at the end of the housing. The size of the zone 98 is approximately thirty times the diameter of the nozzle 68, or five times the diameter of the housing, or both, and the target 100 is about twice the diameter of the nozzle 68.

The target 100 is supported on a bracket 101 which is pivotally mounted for movement into and out of alignment with the nozzle 68. It is mounted on the sides of the nozzle 68 by a shaft 103 extending through the wall of the nozzle to receive a resilient handle 107 that resiliently coacts with the nozzle to locate the nozzle, alternately cross wise as a target for the jet from the nozzle 68, or move and hold the target out of the path of the jet (FIG. 3).

When in the path of the jet a cross frame of six to eight radially disposed thin wall vanes 105 of substantial length extend longitudinally of the nozzle to support the target in the path of the jet stream, and, the vanes stabilize the turbulated mixture flow beyond the periphery of the target for axial and slightly converging non-turbulent flow.

The radiating elements constitute an integral unit formed with a cylindrical tube 109 coaxially aligned with the nozzle 68 to provide non-interference with the jet stream from the nozzle when not supporting the target against the force of the jet stream.

Assuming the nozzle to be disposed in its jet interference position, the stream from the nozzle upon start-up splashes radially from the target 100 against the side wall 102, provides a venturi effect, ingests air around the target, and causes splashed liquid to flow back along the wall and progressively displacing and replacing air in the space around the jet stream. Thereupon without an air supply, through opening 106 the interior of the housing goes "liquid solid" in a fraction of a second and thereafter frictionally engages and directly slows down the jet stream absorbing the kinetic flow energy and discharging the mixture as a soft flow through the nozzle outlet openings 104, which, with the nozzle opening 104 below the surface of the water discharged will not cause any foaming or splashing in a bucket or receiving container.

Of interest under these circumstances is the fact that the target is needed only on start-ups because when the interior of the housing remains filled with liquid, the target is no longer needed to provide a soft flow. Without the splash plate being in an interfering position to start with a hard-flow stream is provided through the round opening, at the integrated vanes 105 or openings. If desired, the opening can be provided with a deflector design to provide a hard-flow pattern such as occurs with a deflecting surface disposed at an acute angle to the stream for fanning out the stream. Preferably, the end of the nozzle N receives secondary nozzle inserts mounted coaxially therein to provide particular cross-sectional flow shapes. Thus, the discharge may be a jet stream, or a spray discharge flow.

In this connection it is to be noted that although the flow of the mixture from the last stage outlet orifice is through an energy-to-pressure conversion diverging wall 98 as described herein, the diverging wall can be eliminated and the stream discharged directly to atmosphere as a hard stream of maximum energy at zero gauge pressure. Also, the diverging wall 98 can be an integral part or a separate element inserted in place in axial alignment with the last stage outlet orifice to provide the energy-to-pressure conversion. This would increase versatility for the relationship illustrated and is one in which an extension conduit can be employed with any discharge nozzle, and the final discharge nozzle can be connected alternately either to the outlet of the mixer directly or the outlet of the extension conduit.

However, the nozzle preferably has at least one air admission opening 106 through the wall near its base at approximately the radial plane of the nozzle 68. A sleeve 108 is slidably mounted externally or a valve on the housing wall 96 to cover all or any portion of the opening 106, and thereby controls the amount of any air aspirated into the nozzle. The opening may be round or oblong for progressive air flow restriction if desired, it being within the purview of the invention to vary the amount of air aspirated when desired.

In the latter instance, the final fixed flow restrictive orifice 68 may be located at the entrance of the discharge nozzle and a chamber 98 be provided therebeyond which is much larger in cross section than that of the restrictive orifice. Moreover, the chamber preferably has a gradually expanding wall 102 which assures a pressure drop at the air entrainment opening 106 to the chamber. This air opening 106 can be adjustably effective to aspirate and entrain varying amounts of air in the mixture that is moving in the chamber. The total area of the aspirating opening 106, or openings on the one hand and the area nozzle of the discharge outlet openings 104 on the other hand have related flow area ratios. Thereby, the air aspirating opening area can be selectively and adjustably used for soft flow or foaming purposes. The sleeve 108 slidably mates with a cylindrical surface 110 on the external wall surface between the shoulder 74 and the shoulder 112 which limits the adjustable movement of the sleeve to control the flow areas of the opening 106 once it is slipped in place over the tapered joint surface for frictional sliding relationship thereon.

EXAMPLE

Assuming a dispensing of nominally 6 gallons of mixture per minute, it is preferred to provide an opening 106 that is 0.330 inches (8.383 mm.) in diameter, thereby affording a flow area of 0.0855 square inches (55.18 sq. mm.). The opening at the inlet 68 is 0.195 inches (4.95 mm) in diameter having a flow area of 0.0299 square inches (19.267 sq. mm.) and a discharge opening 104 of 0.309 square inches (48.381 sq. mm.). The chamber wall is 0.800 inches in diameter (21.336 mm.) at its upstream end and 0.840 inches in diameter (20.32 mm.) at its downstream end which assists in providing a negative pressure of approximately 3.5 p.s.i. at the downstream side of the inlet opening 68 and also assists in providing a comparatively low pressure area at the upstream end of the chamber for the aspiration of air having said inflow area of 0.0855 square inches and outflow area of 0.309 square inches (48.381 sq. mm.). This provides a ratio of areas approaching 1 to 4 and provides with municipal water pressure a projected distance or stream of about 10 feet. If a higher ratio is provided, a soft flow is approached and furthermore, within the limits of its ability to aspirate air through opening 106 as governed by the position of the sleeve 108, a foam output may be provided with the use of foaming agent in the mixture, it being appreciated that the size and taper of the housing also contributes to the pressure drop across the orifice 68.

Thus, it is noted that the hard flow is not hampered with the inflow if the target 100 is removed and if the target is present without air ingestion the input is 0.0299 sq. in. with a baffled outlet of 0.309 sq. in. which provides a soft flow 1 to 10. If the air is added the volume of the mixture is greater and the mixture will flow with an increasing projecting force through the openings 104.

More than one opening 106 may be provided with the total flow area divided among them, but one opening has some advantages over multiple openings. Not only does it simplify tool-up but by locating one hole on the top of the nozzle in making up the joint assembly, the boiling and swirling action inside the nozzle can be easily observed. Also there will be no drippage or drainback from the nozzle in use when the mixing is turned off each time. Furthermore, chemicals being used which might be irritating to the skin are kept from contact with the hand operating the gun if the use of protective gloves is overlooked, and with a hole off-center in the wall of the nozzle, air introduced tangentially assists turbulence and the foaming action. Preferably, the air flow area of the opening is of a size where the amount of air flowing keeps liquid droplets from dripping out, and with the opening on top any criticalness of the magnitude of the opening area is substantially eased because gravity would be of some assistance against drippage.

It is to be noted that the partial vacuum condition developed around the nozzle 68 that opens into the expanding chamber 98 is due in part to the external tapered shape and also to the aspirating effect of the solution that is being discharged from the nozzle into the larger and expanding flow area defined by the nozzle housing 96. This aspirating effect tends to draw a vacuum which without openings 106 assists in establishing and maintaining a turbulating liquid solid condition in the chamber for soft flow. This assures soft flow from the vanes since their total opening or port area would otherwise provide a soft flow for that volume of water which, if discharged directly into the open air as in nozzle N, set for no target interference, would be a hard stream projected as much as 50 feet depending upon the pressure of the municipal water supply at the inlet of the mixer.

On the other hand, when any air is added to the chamber, then this turbulent water is further violently agitated by splash and resurgence, the air adds to the total fluid volume in the chamber and correspondingly to the feed and flow of the mixture through the discharge opening 104 and vanes 105. This speed of flow can range from that rated as a soft flow to a flow which would be projected a distance of 10 feet or more. This speed of flow can be correspondingly varied by varying the amount of air aspirated or the area of the outlet opening or both, since the fluid volume subjected to a flow is free to and will move at a higher rate out through the vaned openings in either or both events. The weight of faster moving water will cause the discharge to assume a directed movement with a directional carry.

The amount of air aspirated may be varied either in the original design or by moving the position of the sleeve 108 for increasing the flow area of the air inlet openings up to a point where the air approaches a substantial mixture volume in the housing which must escape with a substantial increased flow rate. The controlled amount of air admitted thereby can control the projection distance of the discharge stream within reason, and also thereby control splashing that might occur in a bucket being filled as well as the spread of the liquid mixture on the wall if directed against a wall.

Accordingly, a variable air supply will variably relieve the negative gauge pressure around the inlet nozzle, and the softness of the outflow can be varied to control desirable splashing. Furthermore, the added aerated water has a softness or resiliency which controls the splashing of the aerated mixture even at a substantial distance from the discharge opening. Thus, substantial leeway may be provided in the softness of the flow by varying the air aspirated through the openings 106 and mathematically determine the relations between the air and the liquid brought together in the chamber 98 as by varying the air aspirated, substantial control can be established over the flight distance of the ejected stream by varying the relative sizes of the air openings 106 or the discharge port 104 or both.

Furthermore, mixing the water with a foaming agent will result in aspirated air remaining in the water after turbulation of the mixture and its discharge from the housing chamber. As noted, this mixture can be discharged from the chamber with enough force that it will travel a substantial distance. However, instead of bubbles of air being released from the mixture, it will remain in the mixture for foaming purposes when released from ejection pressures. Thus, a foam can be projected substantial distances as directed by the vanes 105 as much as 10 feet or more, it being noted that the more that air aspirated the greater the foaming and the greater the projection of the mixture, and also further foaming of the mixture when contacting an object to be cleaned or when brought into violent contact with a splashing surface exposed to air. Thus, in this relationship the more air aspirated the greater the distance of discharge and the greater the ultimate foaming effect as related directly to the amount of foaming agent present in the solution. This also can be varied or controlled by the slide sleeve 108 or the size of the outlet opening or both.

The versatility and time saving operativeness and performance of the invention with instant selectability among multiple functions is related to the starting and stopping of the flow of water under pressure with one hand manipulating the gun while the other hand quickly adjusts simple controls of the gun which relate to the use or performance of pressurized flowing solvent such as water. The character of the output desired is determined by two controls, one for quickly moving the splash target in and out of the path of the water jet stream to provide a solid jet stream, or a soft flow delivery from the nozzle that can be converted at will to a foam flow by an air inlet valve on the nozzle.

In event of the versatile use of foaming agents in the chemical solute, which is progressively mixed with the water when it flows, and with the air valve on the nozzle open, the movement of the splash target determines whether the discharge is a jet stream that foams upon impact with an object or is foaming as it leaves the nozzle, and if foaming as it leaves the nozzle thin radial vanes supporting the splash target provide flow guides for axially conveying and directing the foam flow from the nozzle.

What is claimed is:

1. In a solution proportioning, mixing and mixture dispensing device having a housing defining a mixing chamber having spaced solvent and solute inlet openings with a mixing zone between them receiving solvent flowing through a converging wall with flow energy in alignment with and a mixture outlet port for the discharge of the mixture from said mixing zone, the relative flow areas between said solvent inlet opening and the outlet port determining the ratio of solute and solvent discharged from said mixing zone under flow energy, said mixture outlet port opening into a diverging wall for converting flow energy to pressure, mixture discharge means connected to the mixture outlet port including a wall defining a compartment having a jet inlet nozzle at one end of a size no greater than the size of said mixture outlet port communicating therewith and opening directly to atmosphere at its other end through a discharge opening many times greater in size than said jet inlet nozzle.

2. The device defined in claim 1 in which said compartment opening to atmosphere includes a splash target disposed in axial alignment with said jet inlet nozzle and is surrounded by vent openings for a soft flow discharge of the mixture therefrom.

3. The device defined in claim 2 in which the wall of the compartment around the jet inlet nozzle has an opening through it to aspirate air into the compartment for dispersion in said mixture.

4. The device defined in claim 3 including a sleeve movable with respect to said air aspirating opening to vary the amount of air aspirated through it.

5. The device defined in claim 1 in which the wall of the compartment around the jet inlet nozzle has a single opening through it to aspirate air into the compartment for dispersion in said mixture.

6. The device defined in claim 5 including means for varying the cross-sectional flow area of said air aspirating opening to vary the air admitted and the speed of discharge through said aspirating opening.

7. Nozzle means having an elongated wall defining a compartment receiving a jet pressure inlet nozzle at its upstream end for liquid mixture under pressure and opening directly to atmosphere at its downstream end through a discharge opening many times greater in size than said jet inlet nozzle and disposed substantially coaxially in alignment therewith, splash target means at least twice the area size of said inlet nozzle supported proximate to said discharge opening for movement into and out of alignment with said discharge opening, wherein the position of said splash target means relative to said discharge opening may be selectively varied within a range from a position substantially perpendicular to the flow of fluid through said nozzle means to a position substantially parallel to said fluid flow, said jet inlet nozzle initially ejecting the mixture with jet flow energy as a jet stream flow directly against said wall and said target means causing it to splash laterally against said wall and ingest air in said compartment for final turbulent mixture discharge through said opening.

8. The nozzle means defined in claim 7 in which said compartment is more than four times the diameter of said jet stream flow and its length approximately thirty times said diameter for extensive axial flow turbulence and mixture of fluids.

9. Nozzle means having an elongated wall compartment receiving a jet pressure inlet nozzle at its upstream end for liquid mixture under pressure and opening directly to atmosphere at its downstream end through a discharge opening many times greater in size than said jet inlet nozzle and substantially coaxially therewith, splash target means about twice the size of said inlet nozzle supported proximate said discharge opening, said jet inlet nozzle initially ejecting the mixture with jet flow energy directly against said wall and target means for it to splash laterally against said wall and ingest air in said compartment, and including a target supporting means carried by the wall for defining a central opening coaxial with and of a smaller size than said target means for supporting the target means.

10. Nozzle means having an elongated wall compartment receiving a jet pressure inlet nozzle at its upstream end for liquid mixture under pressure and opening directly to atmosphere at its downstream end through a discharge opening many times greater in size than said jet inlet nozzle and substantially coaxially therewith, splash target means about twice the size of said inlet nozzle supported proximate said discharge opening, said jet inlet nozzle initially ejecting the mixture with jet flow energy directly against said wall and target means for it to splash laterally against said wall and ingest air in said compartment, including a target supporting means carried by the wall for defining a central opening coaxial with and of a smaller size than said target means for supporting the target means, further including manual means for moving said target means into and out of coaxial alignment with said inlet nozzle to select a jet flow or soft flow of mixture from the discharge opening.

11. A dispensing nozzle for discharging a liquid pressure-jet stream selectively with a soft flow and a hard flow comprising, a nozzle housing defining an elongated flow chamber, a member defining a jet inlet discharge opening receiving liquid under pressure at the upstream end of the nozzle housing, and discharging it into said housing as a jet having flow energy, target means having a target member spaced from and about twice the size of the discharge opening and located proximate the downstream end of the flow chamber, flow escape opening means adjacent to the target means for axially discharging said flow, said inlet discharge opening being operative for ejecting liquid axially directly against said target member for it to impinge upon and splash laterally therefrom against the side wall of the flow chamber, and means for supporting said target member and upstream member for selectively moving them angularly with respect to each other about a radially defined axis into and out of said impingement alignment relation with each other for soft and jet flow respectively.

12. The dispensing nozzle defined in claim 11 including manual means fo tilting at will said target means into and out of impingement alignment with said jet inlet discharge opening.

13. A dispensing nozzle for discharging a liquid pressure-jet stream selectively with a soft flow and a hard flow comprising, a nozzle housing defining an elongated flow chamber, a member defining a jet inlet discharge opening receiving liquid under pressure at the upstream end of the nozzle housing, and discharging it into said housing as a jet having flow energy, target means having a target member spaced from and about twice the size of the discharge opening and located proximate the downstream end of the flow chamber, flow escape opening means adjacent to the target means for discharging said flow, said inlet discharge opening being operative for ejecting liquid directly against said target member for it to impinge upon and splash laterally therefrom against the side wall of the flow chamber, means for supporting said target member and upstream member for selectively moving them with respect to each other into and out of said impingement alignment relation with each other for soft and jet flow respectively, and including manual means extending through the wall of the nozzle housing and movable crosswise thereof for moving said target means at will into and out of impingement alignment with said jet inlet discharge opening.

14. A dispensing nozzle for discharging a liquid pressure-jet stream selectively with a soft flow and a hard flow comprising, a nozzle housing defining an elongated flow chamber, a member defining a jet inlet discharge opening receiving liquid under pressure at the upstream end of the nozzle housing, and discharging it into said housing as a jet having flow energy, target means having a target member spaced from and about twice the size of the discharge opening and located proximate the downstream end of the flow chamber, in which said target means includes an element defining a central opening of a size less than that of the target member but greater than said axially directed jet inlet discharge opening, flow escape opening means adjacent to the target means for discharging said flow, said inlet discharge opening being operative for ejecting liquid directly against said target member for it to impinge upon and splash laterally therefrom against the side wall of the flow chamber, and means for supporting said target member and upstream member for selectively moving them with respect to each other into and out of said impinvement alignment relation with each other for soft and jet flow respectively.

15. A dispensing nozzle for discharging a liquid pressure-jet stream selectively with a soft flow and a hard flow comprising, a nozzle housing defining an elongated flow chamber, which includes thin wall vanes parallel with the nozzle axis of substantial axial length greater than their radial dimension and centrally disposed coaxially with target means, a member defining a jet inlet discharge opening receiving liquid under pressure at the upstream end of the nozzle housing, and discharging it into said housing as a jet flow energy, target means having a target member spaced from and about twice the size of the discharge opening and located proximate the downstream end of the flow chamber, flow escape opening means adjacent to the target means for discharging said flow, said inlet discharge opening being operative for ejecting liquid directly against said target member for it to impinge upon and splash laterally therefrom against the side wall of the flow chamber, and means for supporting said target member and upstream member for selectively moving them with respect to each other into and out of said impingement alignment relation with each other for soft and jet flow respectively.

16. A dispensing nozzle for discharging a liquid pressure-jet stream selectively with a soft flow and a hard flow comprising, a nozzle housing defining an elongated flow chamber, which includes thin wall vanes parallel with the nozzle axis of substantial axial length greater than their radial dimension and centrally disposed coaxially with target means, a member defining a jet inlet discharge opening receiving liquid under pressure at the upstream end of the nozzle housing, and discharging it into said housing as a jet having flow energy, target means having a target member spaced from and about twice the size of the discharge opening and located proximate the downstream end of the flow chamber, flow escape opening means adjacent to the target means for discharging said flow, said inlet discharge opening being operative for ejecting liquid directly against said target member for it to impinge upon and splash laterally therefrom against the side wall of the flow chamber, and means for supporting said target member and upstream member for selectively moving them with respect to each other into and out of impingement alignment relation with each other for soft and jet flow respectively, in which said vanes converge radially and define a central position disposed in axial alignment with said jet inlet discharge opening independently of said relative movement.

17. A dispensing nozzle for discharging a liquid pressure-jet stream selectively with a soft flow and a hard flow comprising, a nozzle housing defining an elongated flow chamber, which includes thin wall vanes parallel with the nozzle axis of substantial axial length greater than their radial dimension and centrally disposed coaxially with target means, said vanes extending crosswise in said nozzle housing and carrying an open ring reinforcement of a size less than that of said target means, a member defining a jet inlet discharge opening receiving liquid under pressure at the upstream end of the nozzle housing, and discharging it into said housing as a jet having flow energy, target means having a target member spaced from and about twice the size of the discharge opening and located proximate the downstream end of the flow chamber, flow escape opening means adjacent to the target means for discharging said flow, said inlet discharge opening being operative for ejecting liquid directly against said target member for it to impinge upon and splash laterally therefrom against the side wall of the flow chamber, and means for supporting said target member and upstream member for selectively moving them with respect to each other into and out of said impingement alignment relation for each other for soft and jet flow respectively.

18. A dispensing nozzle for discharging a liquid pressure-jet stream selectively with a soft flow and a hard flow comprising, a nozzle housing defining an elongated flow chamber, a member defining a jet inlet discharge opening receiving liquid under pressure at the upstream end of the nozzle housing, and discharging it into said housing as a jet having flow energy, target means having a target member spaced from and about twice the size of the discharge opening and located proximate the downstream end of the flow chamber, flow escape opening means adjacent to the target means for discharging said flow, in which said flow escape opening means includes thin wall flow guide vanes parallel with the axis of said nozzle for directing the flow axially from the nozzle, said inlet discharge opening being operative for ejecting liquid directly against said target member for it to impinge upon and splash laterally therefrom against the side wall of the flow chamber, and means for supporting said target member and upstream member for selectively moving them with respect to each other into and out of said impingement alignment relation with each other for soft and jet flow respectively.

19. A dispensing nozzle for discharging a liquid pressure-jet stream selectively with a soft flow and a hard flow comprising, a nozzle housing defining an elongated flow chamber, a member defining an axially directed jet inlet discharge opening receiving liquid under pressure at the upstream end of the nozzle housing, and discharging it into said housing as a jet having flow energy, target means having a target member spaced from and about twice the size of the jet inlet discharge opening and located proximate the downstream end of the flow chamber, in which said target means includes an element defining a central opening of a size less than that of the target member but greater than said axially directed jet inlet discharge opening, means for supporting said target member and upstream member for selectively moving them with respect to each other into and out of impingement alignment relation with each other for soft and jet flow respectively, and flow escape opening means adjacent to the target means for discharging said flow, said nozzle housing having a lateral opening adjacent to and larger than the jet inlet discharge opening for aspirating air directly thereto from the atmosphere to provide selectively a hard flow or a foam flow from said target means with the opening or closing of said lateral opening, and said jet inlet discharge opening operates to eject liquid directly against said target member causing the liquid to impinge upon and splash laterally therefrom against the side wall of the flow chamber.

20. A dispensing nozzle for discharging a liquid pressure-jet stream selectively with a soft flow and a hard flow comprising, a nozzle housing defining an elongated flow chamber, a member defining an axially directed jet inlet discharge opening receiving liquid under pressure at the upstream end of the nozzle housing, and discharging it into said housing as a jet having flow energy, target means having a target member spaced from and about twice the size of the jet inlet discharge opening and located proximate the downstream end of the flow chamber, in which said target means includes an element defining a central opening of a size less than that of the target member but greater than said axially directed jet inlet discharge opening, means for supporting said target member and upstream member for selectively moving them with respect to each other into and out of impingement alignment relation with each other for soft and jet flow respectively, and flow escape opening means adjacent to the target means for discharging said flow, said nozzle housing having a lateral opening adjacent to and larger than the jet inlet discharge opening for aspirating air directly thereto from the atmosphere to provide selectively a hard flow or a foam flow from said target means with the opening or closing of said lateral opening, including means for varying the size of said lateral opening to convert selectively a soft flow to a varying degree of foam flow and said jet inlet discharge opening operates to eject liquid directly against said target member causing the liquid to impinge upon and splash laterally therefrom against the side wall of the flow chamber.

21. A dispensing nozzle for discharging a liquid pressure-jet stream selectively with a soft flow or a foam flow comprising, a nozzle housing defining an elongated chamber having a side wall, a member defining a jet inlet discharge opening at the upstream end of the nozzle housing, target means having a target member spaced from and about twice the size of the jet inlet discharge opening and located proximate the downstream end of the flow chamber, said target member being selectively movable between a position substantially perpendicular to the flow of liquid through the chamber to a position substantially parallel to said flow, flow escape opening means adjacent to the target means for discharging said flow, said jet inlet inlet discharge opening being operative to eject liquid directly against said target member causing said liquid to impinge upon and splash laterally therefrom against the side wall of the flow chamber, said flow chamber having a radially directed air aspirating port laterally through the wall directly to said chamber, and means carried by said nozzle housing for opening and closing said port to provide selectively a jet stream, a foam or a soft flow discharge through said flow escape opening means.

22. A dispensing nozzle for discharging a liquid pressure-jet stream selectively with a soft flow and a hard flow comprising, a nozzle housing defining an elongated flow chamber, a member defining an axially directed jet inlet discharge opening receiving liquid under pressure at the upstream end of the nozzle housing, and discharging it into said housing as a jet having flow energy, target means having a target member spaced from and about twice the size of the discharge opening and located proximate the downstream end of the flow chamber, said target means including an element defining a central opening of a size less than that of the target member but greater than said axially directed jet inlet discharge opening, means for supporting said target member and upstream member for selectively moving them with respect to each other into and out of impingement alignment relation with each other for soft and jet flow respectively, and flow escape opening means adjacent to the target means for discharging said flow, said nozzle housing having a gradually expanding cross-sectional area downstream from said jet inlet discharge opening and said nozzle housing further including a lateral opening adjacent to and larger than the jet inlet discharge opening for aspirating air directly thereto from the atmosphere to provide selectively a hard flow or a foam flow from said target means with the opening or closing of said lateral opening including means for varying the size of said lateral opening to convert selectively a soft flow to a varying degree of foam flow, and said jet inlet discharge opening operates to eject liquid directly against said target member causing the liquid to impinge upon and splash laterally therefrom against the side wall of the flow chamber.

23. A dispensing nozzle for discharging a liquid pressure-jet stream selectively with a soft flow and a hard flow comprising, a nozzle housing defining an elongated flow chamber, a member defining a jet inlet discharge opening receiving liquid under pressure at the upstream end of the nozzle housing, and discharging it into said housing as a jet having flow energy, target means having a target member spaced from and about twice the size of the jet inlet discharge opening and located proximate the downstream end of the flow chamber, said target means including thin wall vanes parallel with the nozzle axis of substantial axial length greater than their radial dimension and supporting the target means centrally for directing the foam flow axially from said nozzle housing target means further including an element defining a central opening of a size less than that of the target member but greater than said axially directed jet inlet discharge opening, means for supporting said target member and upstream member for selectively moving them with respect to each other into and out of impingement alignment relation with each other for soft and jet flow respectively, and flow escape opening means adjacent to the target means for discharging said flow, said nozzle housing having a lateral opening adjacent to and larger than the jet inlet discharge opening for aspirating air directly thereto from the atmosphere to provide selectively a hard flow or a foam flow from said target means with the opening or closing of said lateral opening, including means for varying the size of said lateral opening to convert selectively a soft flow to a varying degree of foam flow and said jet inlet discharge opening operates to eject liquid directly against said target member causing the liquid to impinge upon and splash laterally therefrom against the side wall of the flow chamber.

* * * * *